United States Patent [19]

Suzuki et al.

[11] Patent Number: 4,527,529

[45] Date of Patent: Jul. 9, 1985

[54] METHOD AND APPARATUS FOR CONTROLLING FUEL INJECTION FOR AN INTERNAL COMBUSTION ENGINE

[75] Inventors: Makoto Suzuki, Mishima; Toshiyuki Takimoto, Susono; Mamoru Yoshioka, Susono; Takatoshi Masui, Susono, all of Japan

[73] Assignee: Toyota Jidosha Kabushiki Kaisha, Toyota, Japan

[21] Appl. No.: 550,207

[22] Filed: Nov. 9, 1983

[30] Foreign Application Priority Data

Nov. 16, 1982 [JP] Japan ..... 57-200801
Nov. 24, 1982 [JP] Japan ..... 57-206664

[51] Int. Cl.[3] ..... F02B 3/00
[52] U.S. Cl. ..... 123/478; 123/492
[58] Field of Search ..... 123/478, 492, 480, 486

[56] References Cited

U.S. PATENT DOCUMENTS 4,245,604 1/1981 Lahiff ..... 123/478
4,245,605 1/1981 Rice et al. ..... 123/478
4,266,522 5/1981 Williams et al. ..... 123/492
4,296,722 10/1981 Furuhashi et al. ..... 123/492
4,309,971 1/1982 Chiesa et al. ..... 123/478
4,335,694 6/1982 Mausner et al. ..... 123/478

*Primary Examiner*—Raymond A. Nelli
*Attorney, Agent, or Firm*—Cushman, Darby & Cushman

[57] ABSTRACT

A fuel injection control method for an internal combustion engine in which asynchronous fuel injection can be carried out in accordance with the change in the number of engine rotations and throttle valve opening and asynchronously with the rotations of a crank shaft within a predetermined range of the number of engine rotations while inhibiting the asynchronous fuel injection when the number of engine rotations is not within the range, whereby the lean and over rich conditions of the air/fuel ratio which often occurred in the conventional method for controlling fuel injection can be prevented and acceleration with a good response can be realized.

5 Claims, 12 Drawing Figures

THROTTLE VALVE OPENING TA (deg)
50
30
10
INTAKE AIR FLOW Q (g/rev)
1.0
0.8
0.6
0.4
0.2
TA
Q
TIME (msec)
30
60
90
120
150
CRANK ANGLE (CA)
180°
360°
540°
720°
180°
Tp OPERATIONAL TIMING
FUEL INJ.
T1
T2
T3
τ1
τ2
τ3
OPERATION SEQUENCE OF CYLINDERS
CYLINDER # 1
#3
#4
#2
INTAKE

METHOD AND APPARATUS FOR CONTROLLING FUEL INJECTION FOR AN INTERNAL COMBUSTION ENGINE

BACKGROUND OF THE INVENTION (1) Field of the Invention

The present invention relates to a method and an apparatus for controlling fuel injection for an internal combustion engine, more particularly to a fuel injection control method for internal combustion engine in which the fuel injection is carried out asynchronously with the rotation of a crank shaft at the acceleration time so as to improve the acceleration response, and an apparatus for realizing the method.

(2) Conventionally, in an electronically controlled fuel injection unit for regulating the fuel amount to be injected from a fuel injection valve depending on operating conditions for the internal combustion engine, calculation for the fuel injection amount and control of the fuel injection were performed in accordance with a signal corresponding to the crank angle, which is produced in synchronization with the rotations of the crank shaft.

FIG. 1 shows a timing chart of the fuel injection in which the X axis indicates the time elapsed while the Y axis indicates a throttle valve opening TA and intake air flow Q per one revolution of the engine with the engine speed being constant at 1000 rpm and the change in the intake air flow Q and are shown as correlational characteristics. That is, in FIG. 1, according to the conventional method for satisfying the output required for the engine, the fuel injection amount was calculated in accordance with the intake air flow and the engine speed at the timing of $T_1$ through $T_3$ in synchronization with the rotations of the crank shaft at every crank angle (hereinafter referred to as CA) of 360° (deg.) and the fuel injection was carried out just after the calculation or at the subsequent time period synchronized with the crank signal at every 180° of CA.

For these reasons, acceleration is started just after the calculation of the fuel injection amount at the timing $T_2$ in FIG. 1 and when the intake air flow Q changes rapidly, the fuel injection amount shown by $\tau_2$ is to be insufficient to the actual intake air flow Q. As a result, there is a problem that any cylinder will be in a "lean" condition in the air/fuel ratio and this results in a burning and the engine will be in a so-called "breathed condition", with the result that the acceleration response becomes not good.

In order to improve the problem mentioned above, a method and apparatus for performing fuel injection control has been proposed heretofore in which stamping on or the operation of the accelerator, i.e. the accelerating operation is detected by use of an idle switch and a constant amount of fuel is injected asynchronously with the rotation of the crank shaft. However, the necessary amount for fuel to be injected is largely changed in accordance with the output required, the engine speed, the speed of the operation of the accelerator (variable in the throttle valve opening per unit time), or accelerated conditions of a load when starting acceleration. On the other hand, either excess or shortage of the fuel injection occurs for the required output when the asynchronous fuel injection of the constant amount mentioned above is to be carried out, so that a suitable fuel injection remains unsolved.

Moreover, when the engine speed having a sufficient acceleration response is relatively high without performing the asynchronous fuel injection mentioned above or when the engine is halted at the engine start or it is in a low rotational zone, the operation of the accelerator causes unnecessary fuel to be injected, to that the air/fuel ratio becomes excessively "rich", thus remaining the problems such as degradation of exhaust gas emission and a factor or cause of an unfavorable engine start unsolved.

SUMMARY OF THE INVENTION

It is therefore an object of the present invention to provide a fuel injection control method for an internal combustion engine capable of performing suitable fuel injection in response to various engine operating conditions.

It is another object of the present invention to provide a fuel injection control method for an internal combustion engine in which a suitable asynchronous fuel injection can be carried out in accordance with the change in the engine speed and throttle valve opening and asychronously with the rotaions of the crank shaft.

It is further object of the present invention to provide a fuel injection control method for an internal combustion engine in which the fuel injection is performed for all cylinders at the same time or for each group of the cylinders at a predetermined time period in synchronization with the rotations of the crank shaft in accordance with the operating conditions of the engine and the fuel injection is also performed asynchronously with the rotations of the crank shaft by the deficiency of the fuel produced by the change in the operating conditions during a predetermined time period.

It is still further object of the present invention to provide a fuel injection control method for an internal combustion engine in which an asynchronous fuel injection is performed independent of each cylinder in groups and asynchronously with the rotations of the crank shaft.

It is still another object of the present invention to provide a fuel injection control method for an internal combustion engine in which a lean condition of the air/fuel ratio which often occurred in the conventional method at the time of acceleration can be prevented and acceleration with a good response can be realized.

It is still further object of the present invention to provide a fuel injection control method for an internal combustion engine in which the asynchronous fuel injection is not performed in a certain zone of the engine speed where the fuel is not running short of even when it is in acceleration or just after the engine start and an over rich condition of the air/fuel ratio can be prevented.

It is yet still further object of the present invention to provide a fuel injection control method for an internal combustion engine in which the asynchronous fuel injection method as well as the group synchronous fuel injection is performed by dividing the cylinders into some groups.

It is yet still another object of the present invention to provide a fuel injection control method for an internal combustion engine in which the fuel injection to be asynchronously performed with the rotations of the crank shaft is inhibited when the engine speed is not within a predetermined constant range.

It is still another object of the present invention to provide an apparatus for realizing the method.

One of the features of the present invention resides in the method for controlling fuel injection for internal combustion engine wherein the method comprising the steps of regulating fuel to be injected from a fuel injection valve at a predetermined time period synchronization with the rotations of a crank shaft of the internal combustion engine in accordance with the operating conditions of the engine so as to perform the fuel injection which satisfies an output required for the engine, detecting the variable of throttle valve opening per unit time for every equal time period which is shorter than the predetermined time period, comparing an up-to-date fuel injection amount injected at the predetermined time period before each detected points with an allowable maximum injection amount at each detected point, and performing asynchronous fuel injection independent of the fuel injection for every said predetermined time period and asynchronously with the rotation of the crank shaft when the variable of the throttle valve opening is above a predetermined value and yet the up-to-date or the most new fuel injection amount is below said allowable maximum injection amount.

These and other objects and advantages of the present invention will be apparent from the following description with reference to the accompanying drawings.

PREFERRED EMBODIMENT OF THE PRESENT INVENTION

Figure 2:
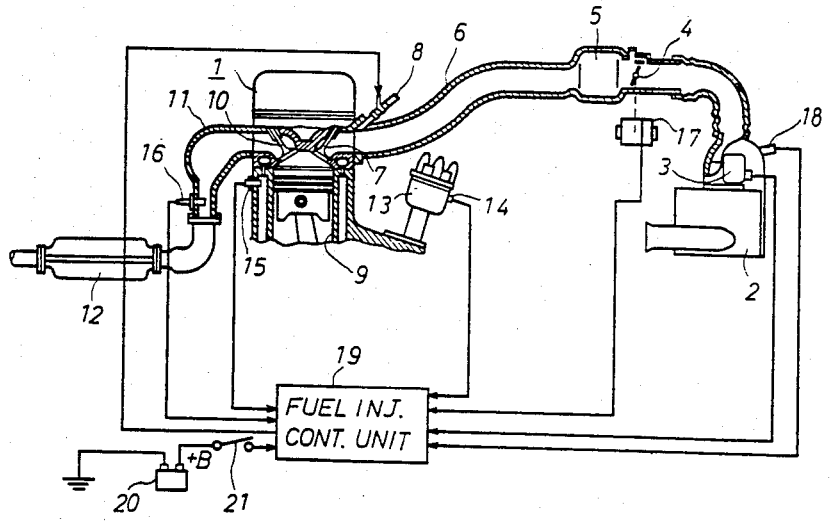
FIG. 2 is an engine system having an electronic fuel injection control unit of an embodiment according to the present invention.

FIG. 2 shows an overall fuel injection system for realizing the fuel injection control method and apparatus according to the present invention. The system comprises an engine 1, an air cleaner 2 provided at the engine, an air flow meter 3 for detecting intake air flow, a throttle valve 4, a surge tank 5, an intake manifold 6 into which air is supplied through an intake valve 7, a fuel injection valve or a fuel injector 8 provided at the intake manifold 6, a cylinder 9 into which the fuel injected from the injector 8 is applied together with air and is ignited by an ignition plug not shown, an exhaust valve 10, an exhaust manifold 11 and an exhaust gas purification apparatus 12 through which the exhaust gas is exhausted into open air.

The fuel injection system also comprises, an air flow meter 3, a crank angle sensor 14 provided at the distributor 13, a temperature sensor 15 provided at the outer wall of the cylinder 9 for detecting the temperature of the engine cooling water, an oxygen sensor 16 provided at the exhaust manifold 11 and for detecting air/fuel ratio, a throttle opening sensor 17 for detecting the opening of the throttle valve 4, an intake air temperature sensor 18 for detecting the temperature of the intake air, and an electronic control unit 19 for controlling the fuel injection through the injector 8. The electronic control unit 19 calculates the fuel injection amount in accordance with various detected signals from each sensor mentioned above and controls the opening time of the fuel injection valve or injector 8 so as to perform optimum fuel injection. The reference numeral 20 indicates a battery power supply and reference numeral 21 indicates a key switch.

Figure 3:
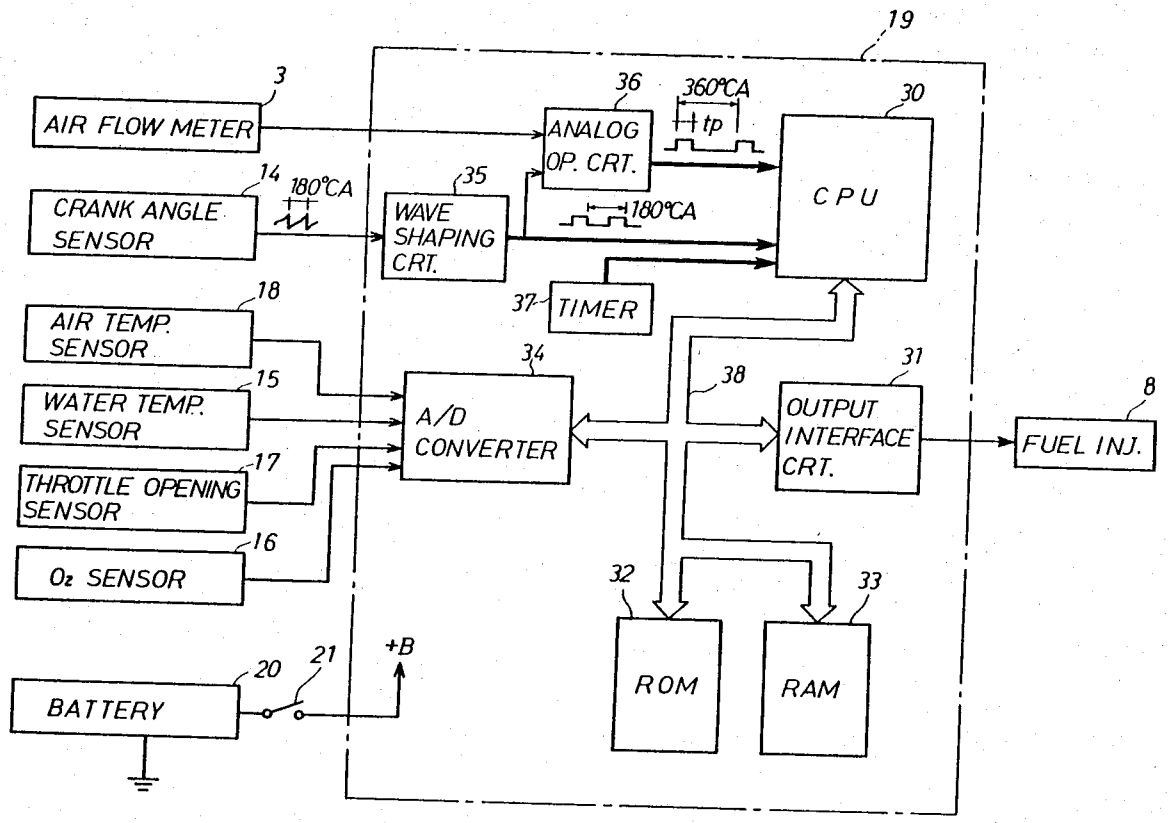
FIG. 3 is a detailed circuit construction of the control unit shown in FIG. 2, together with the various sensors and a meter shown in FIG. 2.

FIG. 3 shows the electronic control unit 19 and the associated sensors 14 through 16 and meter 3 as well as the fuel injector 8, the battery 20 and the idle switch 21. The control unit 19 comprises a microprocessor 30 which is hereinafter referred to as CPU 30, an output interface circuit 31, a ROM (read only memory) 32, a RAM (random access memory) 33, an A/D (analog/-digital) converter 34, a wave shaping circuit 35, an analog operational circuit 36, and a timer 37.

The input of the wave shaping circuit 35 is connected to the crank angle sensor 14 and one input of the analog operational circuit 36 is connected to the output of the air flow meter 3 while other input of the analog operational circuit 36 is connected to the output of the wave shaping circuit 35 which shapes a signal from the crank angle sensor 14. Each output of the two circuits mentioned above are connected to the CPU 30. Each output of the intake air temperature sensor 18, the water temperature sensor 15, the throttle opening sensor 17, the oxygen sensor 16 is connected to the input of the A/D converter 34 having a multiplexer not shown here, which selectively converts analog signals into digital signals to be applied to the CPU 30 and the RAM 33. The ROM 32 stores control programs such as an asynchronous fuel injection operational routine as shown in the flow chart in FIG. 4 and predetermined control data for the CPU 30 and the RAM 33 stores various data from the sensors, which are converted by the A/D converter 34. The output interface circuit 31 interfaces the fuel injector 8 and other units such as the CPU 30, the A/D converter 34, the ROM 32, and the RAM 33 through the data bus 38.

The fundamental fuel injection amount TP is calculated by the analog operational circuit 36 and the valve opening time of the fuel injector 8 is controlled thereby. The timer 37 is used for interruption. The fundamental fuel injection amount TP is corrected by signals such as from the water temperature sensor 15, and oxygen sensor 16 as the case may be, in accordance with a main control program stored in the ROM 32 and, after being corrected as the actual fuel injection amount it is injected from the fuel injector 8 in synchronization with the rotations of the crank shaft.

Figure 4:
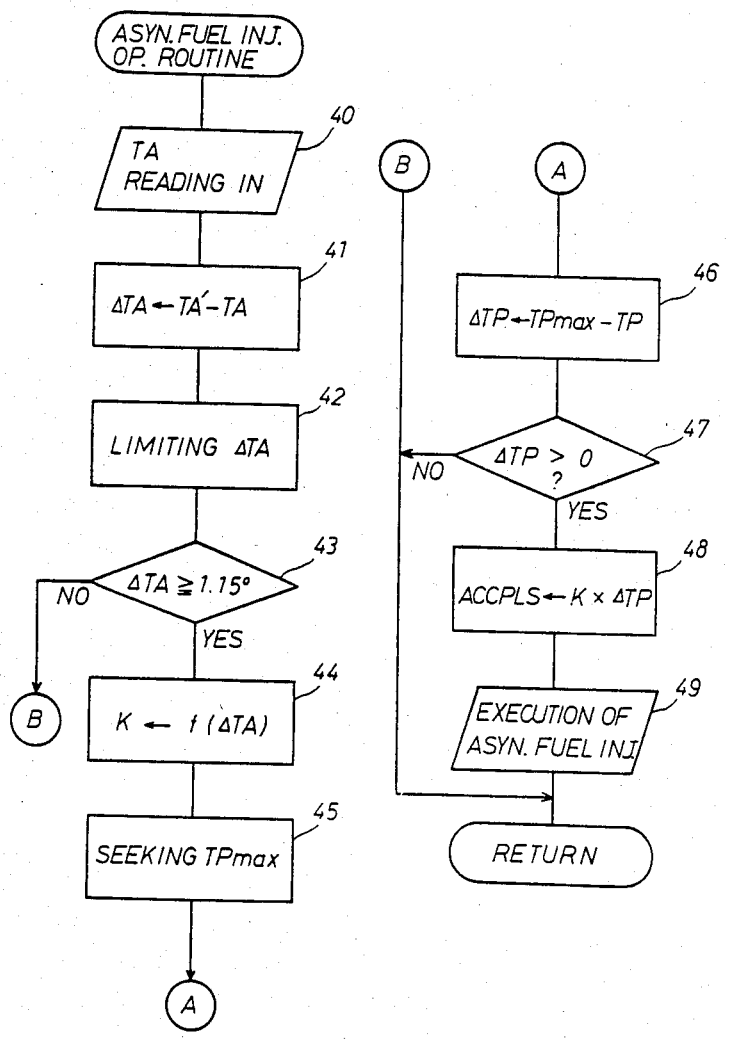
FIG. 4 is an asynchronous fuel injection control program chart of one embodiment according to the present invention.

FIG. 4 shows a program flow chart for calculating the asynchronous fuel injection according to one embodiment according to the present invention. The operation of the asynchronous fuel injection operational routine shown in FIG. 4 is started by an interrupt signal which is produced from the timer 37 for every equal time interval of 4 to 30 msec.

First of all, in a signal corresponding to a step 40 the throttle valve opening TA detected by the throttle valve sensor 17 is read and stored into a predetermined memory area in the RAM 33 and the operation now moves to the next step 41.

In the step 41, the previous throttle valve opening TA which was stored into the RAM 33 in the previous step 40 is subtracted from the throttle opening TA' detected this time and the difference ΔTA is calculated as follows.

$$\Delta TA = TA' - TA \quad (1)$$

In this case, the amount of change in the throttle opening or variable in the throttle opening of the throttle valve 4 is taken as ΔTA, which is opened, for instance, for 16 msec. After this calculation, the operation now moves to the next step.

In the step 42, if the difference ΔTA as the result of the calculation is minus or negative, the fuel already injected can no longer be recovered. On the other hand, if the difference is equal to or larger than a predetermined value of $\theta$ (deg/16 msec) no control is required in accordance with the magnitude ΔTA. Accordingly, if the ΔTA is minus, the difference ΔTA=0 (deg/16 msec) is used while if the ΔTA is above the predetermined value $\theta$, ΔTA=$\theta$ (deg/16 msec) is used. Namely, the upper and lower limitations are imposed to the value of the difference ΔTA.

Figure 5:
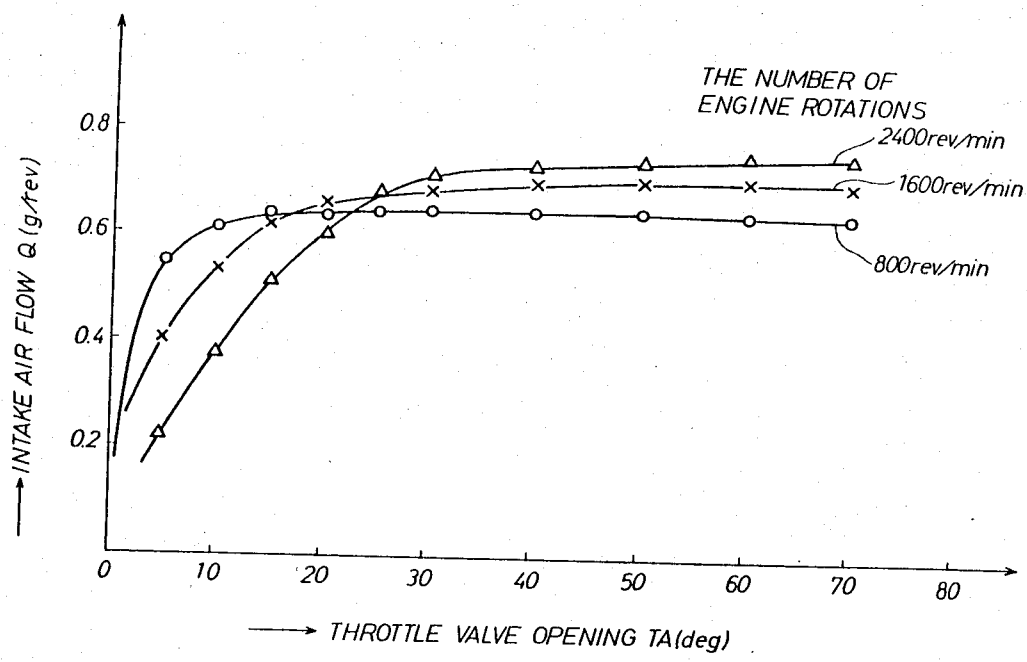
FIG. 5 is some characteristic curves between throttle valve opening and intake air flow with the engine speed being constant respectively.

Now, an explanation is made here of the predetermined constant value of $\theta$. FIG. 5 shows a graph which was obtained by experiment with respect to a relationship between the throttle valve opening TA and the intake air flow Q. As is appreciated from the FIG. 5, the intake air flow Q differs depending upon the engine speed, but almost equal amount of the intake air flow Q full as that in the full opening of the throttle valve is obtainable at TA=10 through 20 deg. However, there are some differences or discrepancies depending on what kind of engines are used. For these reasons, in the step 42, if the upper limit $\theta$ is taken in the order of the value where almost same amount of the intake air flow Q full as that in the full opening of the throttle valve 4, the throttle valve opening variable ΔTA above the upper limit is considered to be in the full opening condition of the throttle valve 4 and is controlled accordingly.

In the next step 43, a decision or determination is made whether or not the variable ΔTA of the throttle valve opening is very small, for instance, 1.15 deg/16 msec. If the result of the decision is YES, i.e. the variable of the throttle valve opening ΔTA is very small, the engine 1 can sufficiently follow the demand of the acceleration thereof without any fuel injection but by asynchronously adding the fuel since the acceleration is slow in this case, with the change in the intake air flow being small.

In this case, if ΔTA is above a predetermined valve, e.g. 1.15 deg/16 msec, the operation now moves to the next step 44.

Figure 6:
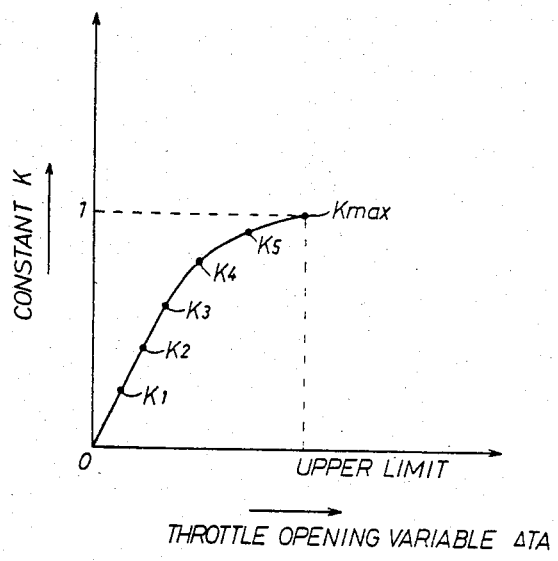
FIG. 6 is a data map of constant K to the variable $\Delta TA$ of the throttle valve opening.

In the step 44, the constant K is retrieved from a constant K data map stored in the ROM 32 which is given by the function $K=f(\Delta TA)$ as shown in FIG. 6, and which is defined by the characteristic curve in FIG. 5 in accordance with the amplitude of ΔTA. In this case, the data map corresponding to the constant $K_1$, $K_2$, $K_3 \ldots K_{max}$ is stored in the ROM 32 in accordance with the difference ΔTA in order to save the memory capacity in which each intermediate point between the two points is calculated by the conventional interporation calculations. The constant K is thus defined in accordance with ΔTA and the operation now moves to the next step.

In the step 45, the allowable maximum injection fuel amount $TP_{max}$ is retrieved or read from the data map stored in the ROM 32 among fundamental fuel injection amounts TP at the current engine speed. After this step, the operation now moves to the next step.

In the step 46, the difference ΔTP between the fundamental fuel injection amount TP corresponding to the fuel already injected and the allowable maximum fuel injection amount TPmax retrieved from the data map in the memory in the previous step 45 is calculated;

$$\Delta TP = TP_{max} - TP \quad (2)$$

In the next step 47, a decision is made if the difference ΔTP calculated in the previous step in accordance with the equation (2) is a positive value or a negative value. If the result of the decision is that there is no difference, i.e. ΔTP=0, it means that the increment of the fuel amount is not required as the fuel corresponding to the allowable maximum fuel injection amount $TP_{max}$ has been already injected.

However, if the result of the decision is that the ΔTP is negative, it means that the fundamental injection amount TP is above the allowable maximum injection amount $TP_{max}$ because of, for instance, ill-response from each sensor and it cannot be said that accurate data is detected in this case. Therefore, the operation in this subroutine terminates in the above two conditions and the operation now moves to the next step 48 only when the difference ΔTP is positive.

In the step 48, an asynchronous fuel injection amount ACCPLS expressed by the following equation is calculated from the constant K calculated in the step 44 and the difference ΔTP calculated in the step 46;

$$ACCPLS = K \times \Delta TP \quad (3)$$

In this case, the interruption interval of this subroutine and the characteristic of the throttle valve enable a plurality of asynchronous injection to be carried out between the previous synchronous injection and the next synchronous injection. In that case, it is preferable to take into consideration of the asynchronous fuel injection amount already injected after the previous synchronous injection. This can be done, for instance, by conveniently setting the constant of K.

In the step 49, the fuel amount corresponding to the value given by the above ACCPLS calculated in the previous step 48 is injected from the fuel injector 8 asynchronously with the rotations of the crank shaft in addition to the fuel amount being injected synchronously with the crank shaft.

Figure 1:
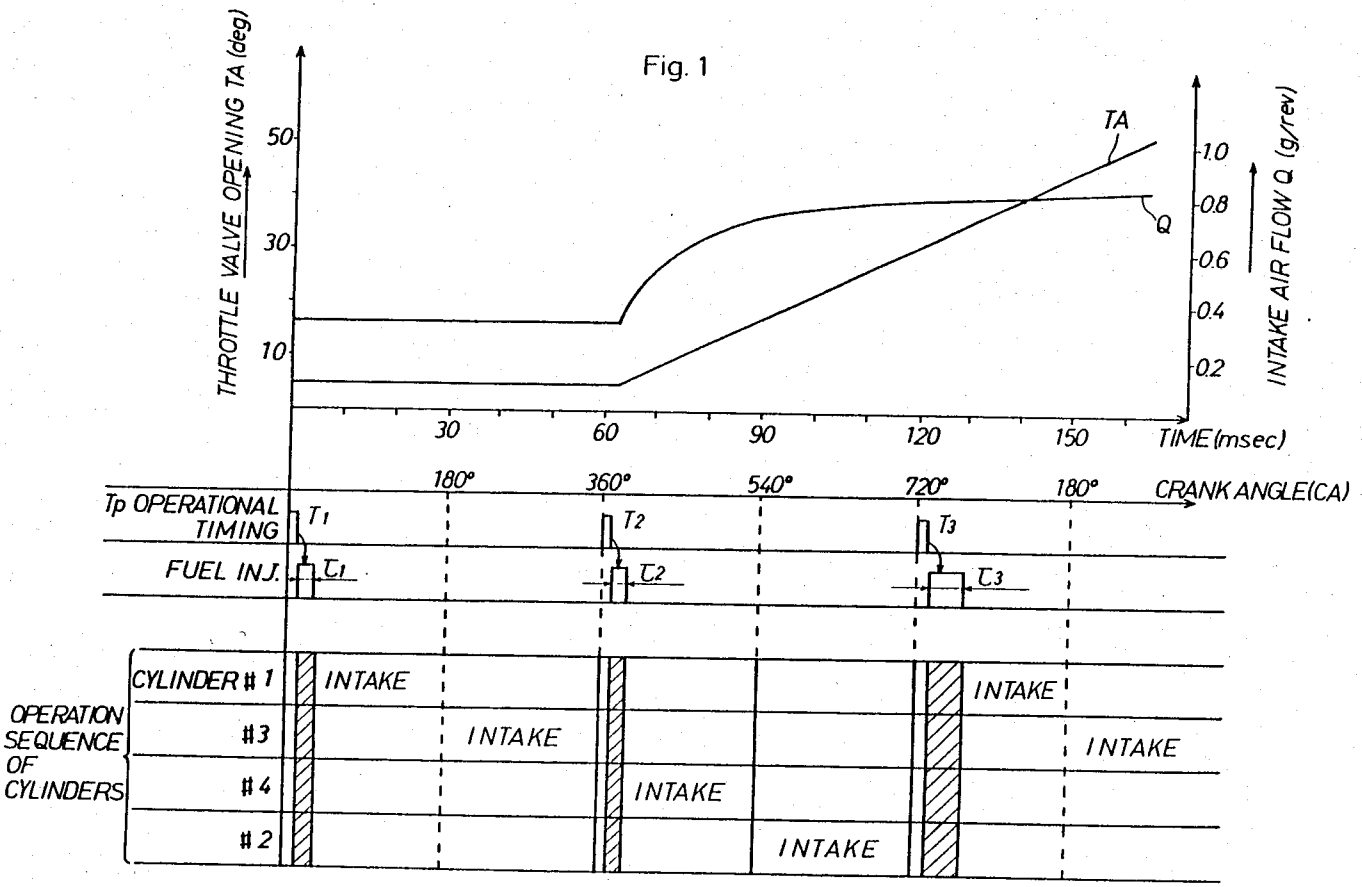
FIG. 1 is a timing chart of the fuel injection control according to the prior art, to be performed synchronously with the rotations of the crank shaft.
Figure 7:
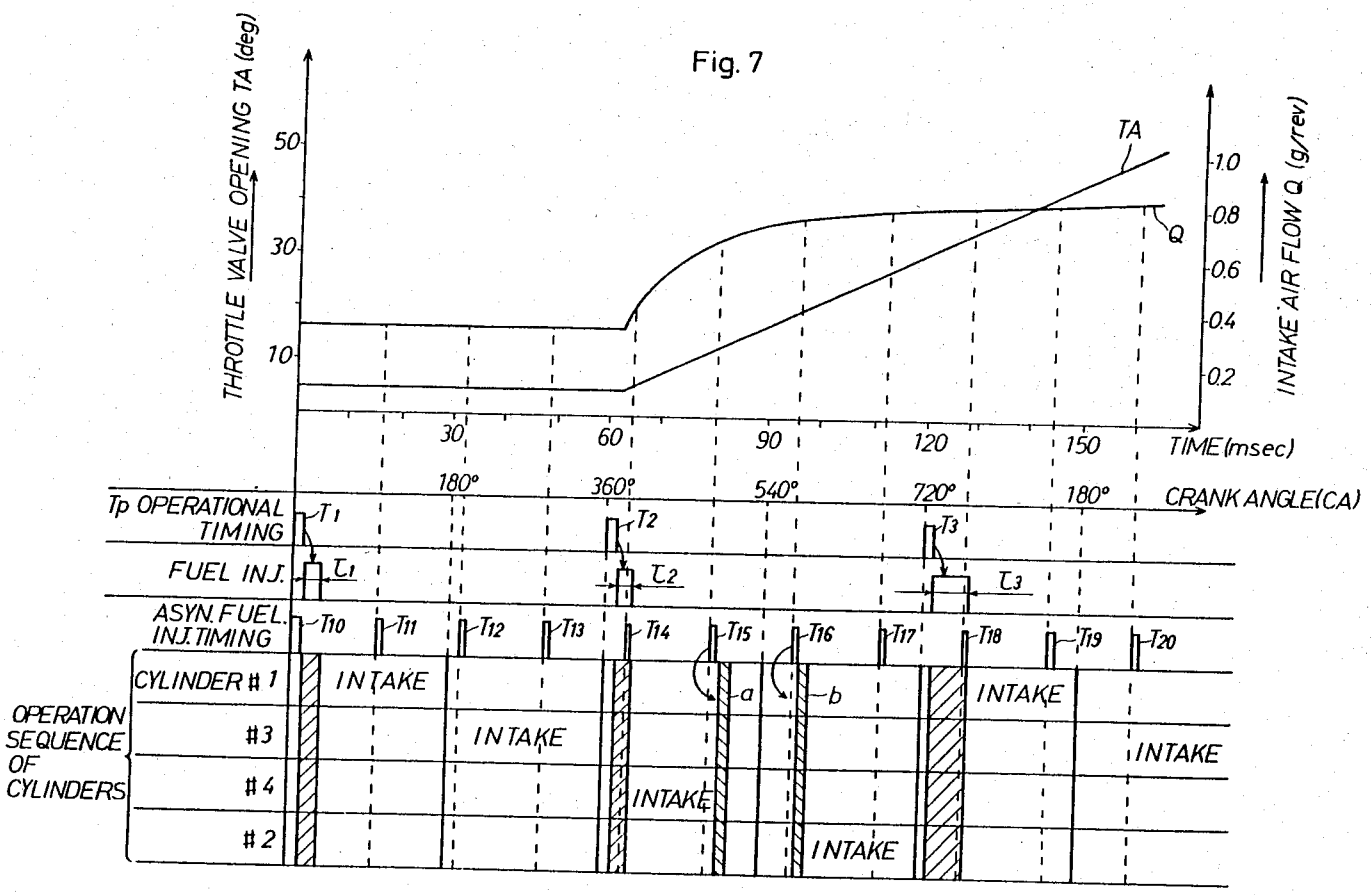
FIG. 7 is a timing chart of the asynchronous fuel injection control according to the present invention which is performed asynchronously with the rotations of the crank shaft.

As a result of the above control, the asynchronous fuel injection is carried out as shown in FIG. 7. FIG. 7 is depicted, based on the same conditions as those shown in FIG. 1. The operation of this embodiment will be as follows:

The actual fuel injection amount $\tau_1$ which is dependent on the fundamental injection amount $TP_1$ calculated at the crank angle 0° CA is carried out at the timing $T_1$ just after its calculation. However, there is no change in the opening of the throttle valve 4 at the timing of the asynchronous fuel injection during the timing $T_{10}$ to $T_{13}$. Accordingly, no asynchronous fuel injection is performed since the intake air flow $Q_1$ is also constant. At the timing $T_{14}$, the accelerator has been already operated and the throttle valve 4 is going to open. However, the degree of the throttle opening is very small compared with that at the timing $T_2$ (the difference between the two is below 1.15 deg), so that no asynchronous fuel injection is carried out.

Moreover, although the fundamental fuel injection amount $TP_2$ is calculated at the timing $T_2$, the intake air flow $Q_2$ at the timing $T_2$ is similar to the intake air flow $Q_1$. Accordingly, $TP_2$ becomes same as $TP_1$ and the fuel injection is carried out by the actual injection amount $\tau_2$ in accordance with the $TP_2$ to each cylinder at the timing just after the timing $T_2$. However, the change in the opening $TA_3$ of the accelerator at the timing $T_3$ is larger than that in the accelerator opening $TA_2$ at the timing $T_2$, so that it will result in a fuel deficiency with the actual injection amount $\tau_2$ since the intake air flow has been increased. Accordingly, the constant $K_{14-15}$ is sought in accordance with the variable of the throttle valve opening $\Delta TA_{14-15}$ between the timing $T_{14}$ and $T_{15}$, and the difference $\Delta TP_{15}$ between the allowable maximum fuel injection amount $TP_{max15}$ at the engine speed at that time and the fundamental injection amount $TP_2$ is calculated. This in turn enables the asynchronous fuel injection amount $ACCPLS_{15}$ to be calculated as shown in FIG. 7, marked by a, with the result that the asynchronous fuel injection is carried out just after the timing $T_{15}$. Similar calculation is also performed at the timing $T_{16}$ and the asynchronous fuel injection amount $ACCPLS_{16}$ is calculated thereby, as marked with b in FIG. 7. In this case, when calculating the asynchronous fuel injection amount $ACCPLS_{16}$, the operation performed in the program step 48 is to be carried out since the $ACCPLS_{15}$ is injected asynchronously.

At the timing $T_{17}$, no asynchronous fuel injection is carried out as the necessary fuel amount has been already injected asynchronously. In addition, since the actual injection amount $\tau_3$ depending on the fundamental fuel injection amount $TP_3$ calculated at the timing $T_3$, has been already calculated in accordance with the similar intake air flow $Q_3$ as that at the full throttle opening, $TP_{max3}$ is obtainable and there is no necessity of asynchronously carrying out the fuel injection in this case. Accordingly, no asynchronous fuel injection will be carried out depending upon the operation of the asynchronous fuel injection calculating subroutine at the timings $T_{18}$ through $T_{20}$.

In the foregoing embodiment, no asynchronous fuel injection is required when the change in the intake air flow Q is small and a slow acceleration is being performed with the $\Delta TA$ being very small, as only the actual fuel injection amount $\tau$ based on fundamental injection amount TP enables to keep track of its acceleration. Consequently, only an insufficient fuel amount when a rapid acceleration is required, can be supplemented by the asynchronous injection, which cannot be covered by the conventional fuel injection method.

Moreover, no fuel injection can be carried out above the allowable maximum fuel injection amount due to the term $(TP_{max}-TP)$, thus enabling the asynchronous fuel injection with a good response in accordance with each changing acceleration condition at every moment.

In the foregoing embodiment, the operation interval is taken at every 16 msec in the subroutine. However, shortening of the interval enables a more sophisticated control to be carried out with the constant K of the data which can conveniently selected and set.

In the foregoing first embodiment according to the present invention, the method and apparatus for performing the asynchronous fuel injection control in addition to all cylinders synchronous injection system has been described.

Now, a method and apparatus for performing group asynchronous fuel injection plus group synchronous fuel injection system as a second embodiment according to the present invention will be explained in which cylinders are devided into some groups. In this fuel injection method, cylinder identification can be done by the crank angle sensor 14 which is possible to detect a "dead point" on a particular cylinder. The overall engine system construction of hardware including an, the control unit and the control programs are almost same as those shown in FIGS. 2 and 3 except for performing the group synchronous fuel injection at every 360° CA, so that the operation of the second embodiment will now be made with reference to FIG. 8 which is depicted on the similar conditions as those shown in FIG. 1.

Figure 8:
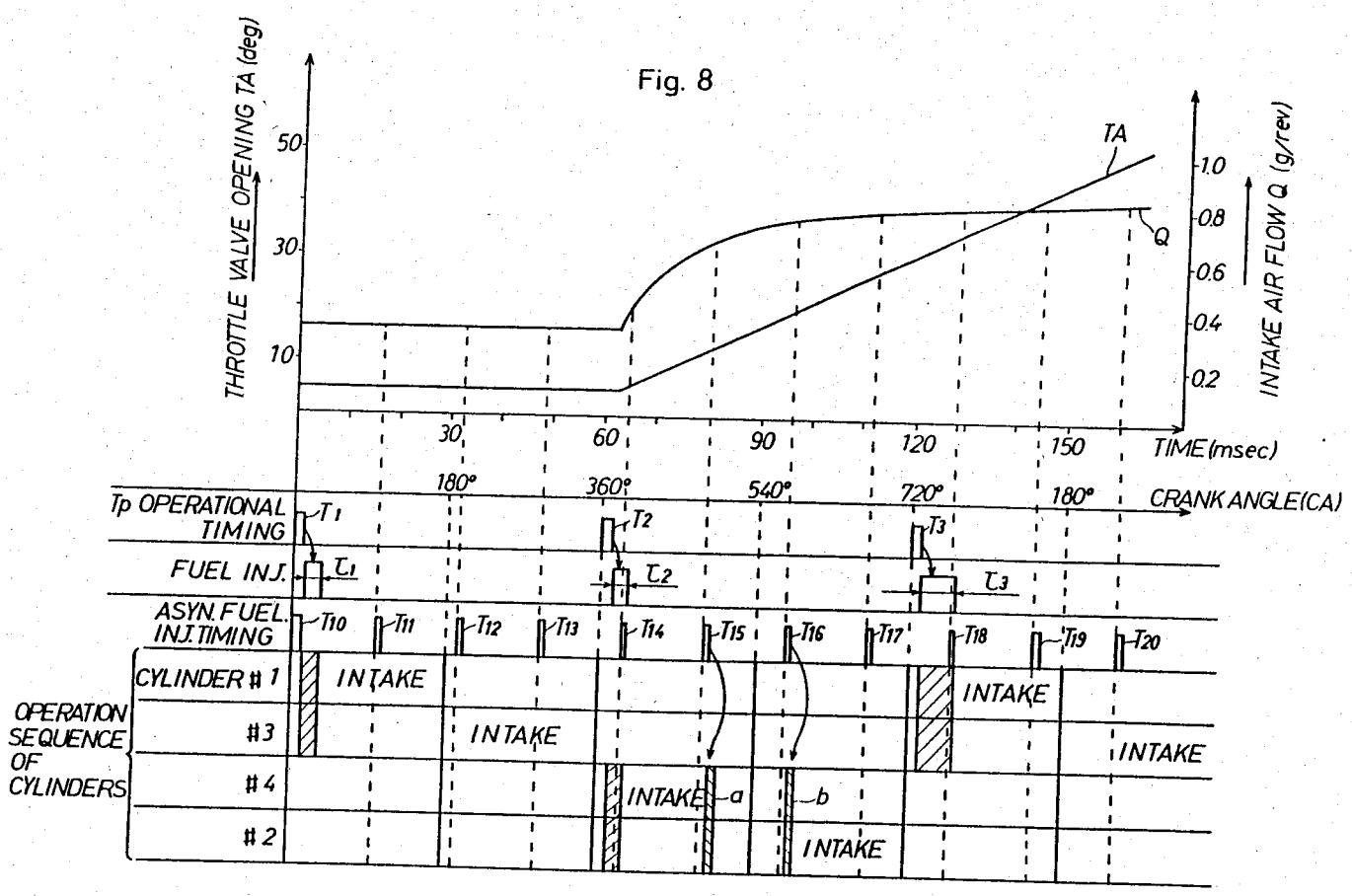
FIG. 8 is another timing chart of the asynchronous fuel injection control of another embodiment according to the present invention in which cylinders are divided into two groups, FIGS. 9 (I), (II), and (III) are control program flow charts of the third embodiment according to the present invention.

In FIG. 8, in the second embodiment according to the present invention, the fuel injection is carried out by two groups, i.e. a group A consisting of the first and third cylinders and a group B consisting of the second and forth cylinders. The operation of the asynchronous fuel injection is carried out every 16 msec with respect to the groups A and B. Namely, at the timing $T_1$, as the throttle valve 4 is not opened, no asynchronous fuel injection is required in addition to the actual fuel injection amount $\tau_1$ based on the fundamental fuel injection amount $TP_1$ of the group A, which was calculated at the timing $T_1$. Accordingly, no asynchronous fuel injection is carried out at any timing between $T_{11}$ and $T_{13}$.

On the other hand, the fuel injection of the actual injection amount $\tau_2$ is performed in accordance with the fundamental fuel injection amount $TP_2$ for the group B, which was calculated just after the timing $T_2$. A decision is made for the variable $\Delta TA$ of the opening of the throttle valve 4 at the timing $T_{14}$. However, since the change is very small, no asynchronous fuel injection is carried out and the change in the throttle valve opening 4 is detected only at the timing $T_{15}$ and $T_{16}$. A a result, the fuel injection corresponding to the asynchronous fuel injection amounts $ACCPLS_{15}$ and $ACCPLS_{16}$ is carried out as shown by a and b in FIG. 8 with respect to the group B. Similar operation is to be performed afterward and same effects as those in the first embodiment can be obtained in this second embodiment.

In FIG. 8, although the asynchronous fuel injection is performed by only the group B for the purpose of simplification in description, the asynchronous fuel injection is actually carried out in any group, if necessary. Moreover, in the second embodiment, the asynchronous fuel injection is carried out for each group of the cylinders. However, almost same effects can be obtained by carrying out either the synchronous fuel injection for each group or the asynchronous fuel injection of all cylinders at the same time.

In the following third embodiment which is going to explain hereinafter no asynchronous fuel injection is carried out in a zone where the engine speed is high and a sufficient acceleration response is obtainable without performing the asynchronous fuel injection mentioned above in addition to the content of the second embodiment, and at the time of engine start.

Figure 9:
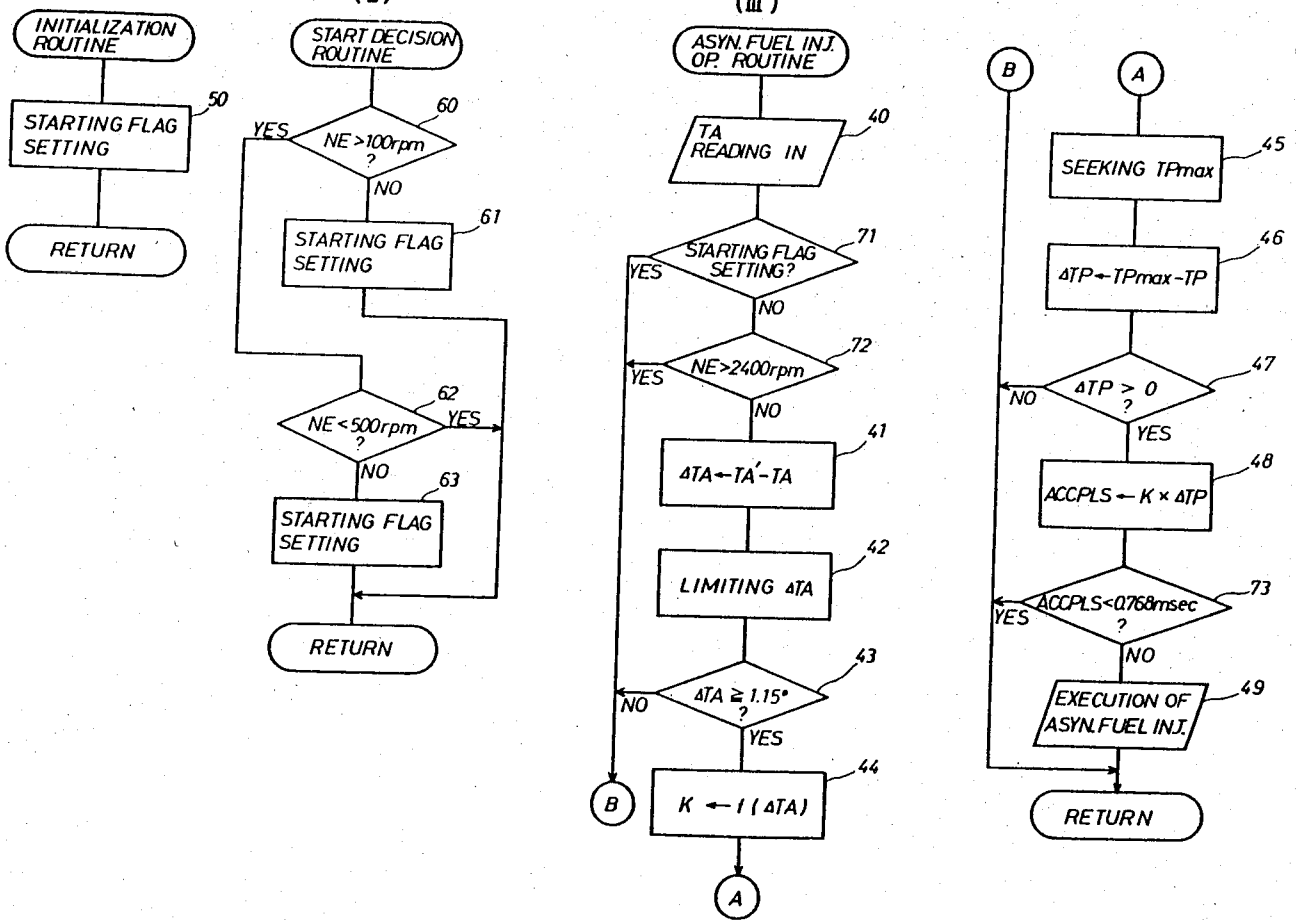

FIG. 9 shows how the program control is performed in accordance with the embodiment according to the present invention. Since the construction of the engine system and the control unit for the fuel injection is same as that shown in the embodiments in the foregoing, a more detailed description thereof will not be necessary.

The operations of the third embodiment according to the present invention will now be explained with reference to each operation flow chart in FIG. 9. First of all, in FIG. 9 (I) the operation of the initialization routine is performed just after the key switch 21 is turned on. When this routine is started, a start flag which indicates that the engine is starting is set to "1" in the step 50 and after that this routine terminates.

In FIG. 9 (II), the operation of a start decision routine is performed, which carries out SET and RESET operations for the start flag. When other interruption operation is not performed, this routine is always executed. When this routine is started, the current engine speed NE which was calculated and stored in the RAM memory 33 during the running of the main routine not shown, is read from the memory 33 and a decision or determination is made in the step 60 if the value is larger than a predetermined value, for instance 100 rpm. If the result of the decision is NO, that is, the current engine speed NE is less than the predetermined value of 100 rpm, the operation now moves to the step 61.

In the step 61, if the start flag has been already set at "1", this set condition is maintained, while if the flag has been reset, i.e. in the "0" state, the operation for setting back to "1" is performed and the operation of this routine terminates.

On the other hand, if the result of the decision in the step 60 is YES, that is, the current engine speed NE is larger than the predetermined value of 100 rpm, the operation now moves to the next step 62. In the step 62, a decision is made whether or not the engine speed NE is less than a predetermined value of 500 rpm. If the result of the decision is YES, that is, the number of engine rotations is less than 500 rpm, the operation of this routine terminates. However, if the result of the decision is NO, that is, the engine speed is larger than 500 rpm, the operation now moves to the next step 63.

In the step 63, the start flag is reset, that is, the flag becomes "0" condition and the operation of this routine terminates.

FIG. 9 (III) shows an asynchronous fuel injection routine in which an operation for suspending the asynchronous fuel injection is added to the control program shown in the first embodiment according to the present invention. Accordingly, the same portions of the operation as those described in the first embodiment are labelled by the same reference numerals so that further explanation will not be necessary here.

In the asynchronous fuel injection routine of FIG. 9 (III), a decision is made whether or not the start flag has currently been set in the step 71. If the result of the decision of YES, that is, the flag has been set, it means that no asynchronous fuel injection is required, with the result that this routine terminates in this case. However, if the flag has not been set, that is, it is in the reset condition, the operation now moves to the next step 72.

In the step 72, a decision is made whether or not the engine speed NE is in a predetermined relatively high rotation zone, for instance 2400 rpm in the present embodiment (this value may differ from engine to engine) or higher than the zone, where a sufficient acceleration response is obtainable and no asynchronous fuel injection is required. If the result of the decision is YES, that is, the engine speed NE is larger than the value of 2400 rpm, this routine terminates. However, if the engine speed NE is less than 2400 rpm, the operation now moves to the next step 41. The operations to be performed in the steps 41 through 48 are all same as those shown in FIG. 4. Accordingly, no further explanation will be necessary.

In the step 73 after the execution of the step 48, a decision is made whether or not the asynchronous fuel injection amount ACCPLS which was calculated in the previous step 48 is smaller than the predetermined minimum value which can be accurately injected by the fuel injector 8, i.e. the minimum valve opening time (in the embodiment according to the present invention, the value is selected as 0.768 msec). If the result of the decision is YES, that is, the injection amount ACCPLS is less than the value of 0.768 msec, the operation of this routine terminates. On the other hand, however, the injection amount ACCPLS is larger than the value of 0.768 msec, the operation now moves to the next step 49 so as to perform the asynchronous fuel injection.

Figure 10:
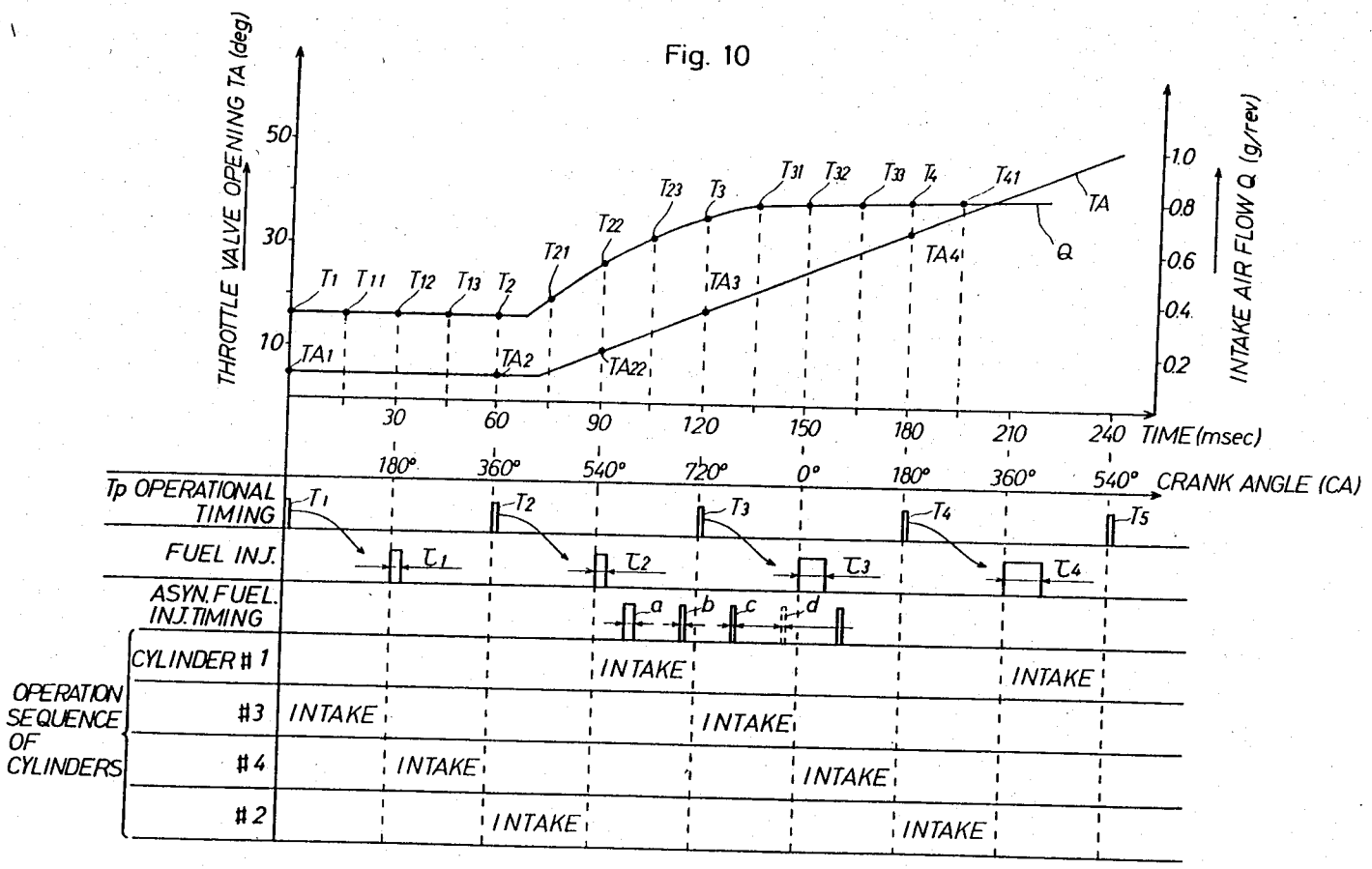
FIG. 10 is a timing chart of the fuel injection control of the third embodiment according to the present invention in a slow acceleration time or in the high engine speed.

As a result of the asynchronous fuel injection control by the operational routine mentioned above, the asynchronous fuel injection is carried out as shown in FIG. 10.

In FIG. 10, first of all, the actual fuel injection amount $\tau_1$ is performed at the timing $T_{12}$ in accordance with the fundamental fuel injection amount $TP_1$ calculated at the timing $T_1$. However, there is no change in the opening of the throttle valve 4 at the timing of $T_{11}$, $T_{12}$, $T_{13}$, and $T_2$ and accordingly, the intake air flow $Q_1$ is maintained constant. As a result, no asynchronous fuel injection is performed in this case. At the timing of $T_{21}$, the throttle valve 4 is going to open by the operation of the accelerator already made, but the degree of the opening is very small compared with the one at the timing $T_2$, for instance, the difference is less than 1.15 deg, so that no asynchronous fuel injection is performed.

Moreover, although the actual fuel injection amount $\tau_2$ is calculated in accordance with the fundamental injection amount $TP_2$ at the timing $T_2$ similarly, the intake air flow $Q_2$ in this case, i.e. at the timing $T_2$, is same as $Q_1$. Accordingly, the actual fuel injection amounts $\tau_2$ and $\tau_1$ are substantially same and the fuel injection of the amount $\tau_2$ is thus performed for each cylinder at the timing $T_{22}$. However, the accelerator opening $TA_{22}$ at the timing $T_{22}$ where the actual fuel injection is performed will be changed so as to be larger than that in the accelerator opening $TA_{21}$. As a result, the intake air flow also increases and this causes the fundamental fuel injection amount $TP_2$ to be deficient. Accordingly, the constant $K_{21-22}$ is sought in accordance with the variable $\Delta TA_{21-22}$ of the throttle valve opening between the timing $T_{21}$ and the timing $T_{22}$ and the difference between the allowable maximum fuel injection $TP_{max22}$ and the fundamental fuel injection $TP_2$ at the engine speed NE at that time and then the asynchronous fuel injection amount $ACCPLS_{22}$ can be calculated as indicated by a in FIG. 10, thus enabling the asychronous fuel injection prior to the timing $T_{23}$. In the manner as described, similar calculations are carried out at the timing $T_{23}$, $T_3$, $T_{31}$ and the corresponding asynchronous fuel injection amounts $ACCPLS_{23}$, $ACCPLS_3$ and $ACCPLS_{31}$ are obtainable as shown by b, c and d in FIG. 10.

When calculating the $ACCPLS_{23}$ in the above, since the amount $ACCPLS_{22}$ is being asynchronously injected, it follows that the fundamental fuel injection amount $TP_2$ which is used in the calculation becomes the sum of $TP_2$ and $ACCPLS_{22}$. This can also apply to $ACCPLS_3$ and $ACCPLS_{31}$. Furthermore, the asynchronous fuel injection amount $ACCPLS_{31}$ as the result of the calculation at the timing $T_{31}$ as shown by the dotted line d in FIG. 10 is below or less than the value corresponding to the time of 0.768 msec, so that no actual asynchronous fuel injection is carried out.

On the other hand, the actual fuel injection amount $\tau_4$ calculated at the timing $T_4$ is the one which has been also calculated already in accordance with the fully opened condition of the throttle valve and the intake air flow $Q_4$ at that time, so that no asynchronous fuel injection is needed in this $TP_{max4}$ condition. Accordingly, no asynchronous fuel injection can be performed by the asynchronous fuel injection routine at the timing $T_4$ and $T_{41}$.

Although not shown in FIG. 10, when the engine is stopped or the engine starts operating at a low revolution zone, the start flag is set so that unnecessary asynchronous fuel injection is not carried out by any means even if an accidental operation of the accelerator is brought about by the driver without the intention of acceleration by him in that case.

Moreover, no occational changes in the set and reset conditions of the start flag occur as a hysterisis characteristic is given for the set and reset operations of the flag, even if the engine speed NE goes hunting at its low revolution zone.

As described in the foregoing embodiments according to the present invention, when a slow acceleration is carried out or when the engine is operated in a relatively high revolution zone with a small variable $\Delta TA$ of the throttle opening, no asynchronous fuel injection is carried out in that case, as only the fundamental fuel injection amount TP permits to keep track of the acceleration at that time and an actually deficient fuel amount can be supplemented asynchronously at the time of rapid acceleration which cannot be covered by the conventional fuel injection method. As a fuel injection amount is determined by $(Tp_{max}-Tp)$, a fuel injection amount is not more than the allowable maximum injection amount and the asynchronous fuel injection is performed according to accelerating conditions at every moment with a good response.

Moreover, the asynchronous fuel injection cannot perform when the engine is stopped and no actual acceleration is imposed, or when the engine is being operated in a low revolution zone while the set condition of the start flag to be set in the low revolution or rotation zone is not subject to occasional changes, with the result that a chattering phenomena which causes the asynchronous fuel injection to occur in the low engine rotation zone, can be prevented.

In the foregoing embodiment, the operation of the routine has been described as being done for every 16 msec. However, shortening of the interval of the operation time enables a more sophisticated or accurate control to be done.

It is also possible to make a decision for inhibit of the asynchronous fuel injection, not only in accordance with the engine speed but also in accordance with other factors such as intake manifold negative pressure, or intake air flow to the engine speed ratio.

In the foregoing embodiments, the asynchronous fuel injection method with all cylinder synchronous injection system incorporated therein has been described. However, it is also possible for the method according to the present invention to be applied to the asynchronous fuel injection method in addition to the group synchronous fuel injection system in which the fuel injection is carried out by dividing the cylinders into some groups. When carrying out the fuel injection in groups in a similar case as mentioned above, the operations are almost same as those which have been described in the foregoing embodiments except that cylinder identification is carried out and the dead point of a particular cylinder can be detected by the crank angle sensor 14.

Moreover, as described in the foregoing, the fuel injection control and apparatus for an internal combustion engine according to the present invention characterized in that firstly the fuel injection is performed for all the cylinders at the same time or for each group of the cylinders at a predetermined time period synchronized with the rotations of the crank shaft in accordance with the operating conditions of the engine and the fuel injection is also performed asynchronously with the rotations of the crank shaft due to the deficiency of the fuel produced by the changes in the operating conditions during the predetermined time period, and in that secondly the fuel injection performed asynchronously with the rotations of the crank shaft is inhibited unless the engine speed at that time is within a predetermined constant range. Hence, in the fuel injection and apparatus according to the present invention, a lean condition of the air/fuel ratio which often occurred in the conventional method at the time of acceleration, can be prevented and an acceleration with a good response can be realized.

Moreover, in the fuel injection method and apparatus according to the present invention, optimum asynchronous fuel injection can be carried out in accordance with the changes in the engine speed and throttle valve opening, so that degradation of emission can be prevented at any acceleration conditions.

In addition, the over rich condition of the air/fuel ratio can be prevented, as the asynchronous fuel injection is not performed in a certain zone of the engine speed where the fuel is not running short of even when it is in the acceleration condition or just after the engine start, and an improvement in fuel consumption as well as an improvement in the emission can be realized.

Finally, the fuel injection control method and apparatus according to the present invention can be realized by utilizing the conventional fuel injection unit without the necessity of any particular additional apparatus.

While the present invention has been described in its preferred embodiments, it is to be understood that the words which have been used are words of description rather than limitation and that various changes and modifications may be made within the purview of the appended claims without departing from the true scope and spirit of the invention in its broader aspects.

What is claimed is:

1. An apparatus for electronic fuel injection for an internal combustion engine which comprises the following means;

first means which outputs a synchronous fuel injection controlling signal to the injector at a predetermined time period synchronized with the rotation of a crank shaft of the engine in accordance with operating conditions of the engine;

second means comprising as follows:

memory means for reading the throttle opening TA detected by a throttle valve sensor to store into a predetermined memory area in a RAM;

calculating means for calculating ΔTA which is obtainable by subtracting the throttle opening TA OLD detected this time from the previous throttle valve opening TA stored in RAM;

limiting means for regulating the upper and lower limitations to determine $\Delta TA=0$ in the case the value of ΔTA is minus, and to determine $\Delta TA=\theta$ in the case the value of TA is larger than $\theta$;

comparing means for comparing whether the variable ΔTA is greater than a predetermined value;

retrieving means for retrieving the constant K from the constant K data map which is stored in a ROM and given by the function $K=f(\Delta TA)$ in accordance with ΔTA in the case that said variable ΔTA of the throttle valve is larger than said predetermined value;

third means which compares an up-to-date fuel injection amount TP injected from the first means before detecting the variable of said throttle valve openings ΔTA with an allowable maximum injection amount TPmax detected at said detected points; and fourth means which outputs an asynchronous fuel injection controlling signal performed asynchronously with the number of the rotation of the crank shaft as well as said asynchronous fuel injection controlling signal in accordance with a result ACCPLS obtained by multiplying said constant K by a difference ΔTP; ΔTP is a difference between said allowable maximum injection amount TPmax and said up-to-date fuel injection amount TP to the injector when said variable of throttle valve openings ΔTA is larger than a predetermined value and when said up-to-date fuel injection amount TP is smaller than said allowable injection amount TPmax.

2. An apparatus for electronic fuel injection for an internal combustion engine as claimed in claim 1 wherein said third means comprises as follows:

means for retrieving an allowable maximum injection fuel amount TPmax from a data map stored in the ROM among fundamental fuel injection amount TP at current number of engine rotations;

means for calculating a difference ΔTP between said allowable maximum injection fuel amount TPmax and fundamental fuel injection amount TP corresponding to a fuel already injected in the first means and means for detecting whether said difference ΔTP is positive or negative.

3. An apparatus for electronic fuel injection for an internal combustion engine as claimed in claim 2 wherein said fourth means comprises the following means:

means for calculating an asynchronous fuel injection amount ACCPLS multiplied by said retrieved constant K and calculated ΔTP when the ΔTP is determined to be positive; and means for generating an asynchronous fuel injection controlling signal corresponding to said asynchronous fuel injection amount ACCPLS to output said asynchronous fuel injection controlling signal to the injector.

4. An apparatus for electronic fuel injection for an internal combustion engine as claimed in claim 3 additionally comprising the following means:

means for detecting whether or not the number of the engine rotations is larger than that of a first engine rotations to carry out setting of the starting flag in case that the number of engine rotations is smaller than that of said first engine rotations;

means for determining whether or not the number of engine rotations is smaller to carry out resetting the flag while the engine is rotating in case the number of the rotations is larger than that of said second engine rotation; and means for determining whether or not the number of engine rotations is larger than the third engine rotations only when said starting flag has reset said means for determining, and permitting the output of an asynchronous fuel injection controlling signal to the injector when the number of engine rotations is smaller than said third engine rotations; and the relation among the first engine rotations and the second engine rotations, and the third engine rotations is indicated by the number of first engine rotations < the number of second engine rotations < the number of third engine rotations.

5. An apparatus for electronic fuel injection for an internal combustion engine as claimed in claim 3 comprises the following means added to means for calculating the asynchronous fuel injection amount ACCPLS:

means for determining whether or not the asynchronous fuel injection amount ACCPLS is smaller than a predetermined minimum value which is capable of being accurately injected by the injector;

means for generating said asynchronous fuel injection controlling signal only when said asynchronous fuel injection amount ACCPLS is larger than said minimum value.

* * * * *